US007766663B2

(12) United States Patent
Yazawa et al.

(10) Patent No.: US 7,766,663 B2
(45) Date of Patent: Aug. 3, 2010

(54) COAXIALLY CONNECTED STRUCTURE FOR OPPOSED WIRING SUBSTANCES AND DEVICE HAVING THE SAME

(75) Inventors: Shigehito Yazawa, Fukushima (JP); Goro Suemitsu, Tokyo (JP); Satoshi Hagiwara, Fukushima (JP)

(73) Assignees: NEC Corporation, Tokyo (JP); NEC Wireless Networks, Ltd., Fukushima (JP)

( * ) Notice: Subject to any disclaimer, the term of this patent is extended or adjusted under 35 U.S.C. 154(b) by 0 days.

(21) Appl. No.: 12/329,900

(22) Filed: Dec. 8, 2008

(65) Prior Publication Data

US 2009/0149040 A1 Jun. 11, 2009

(30) Foreign Application Priority Data

Dec. 7, 2007 (JP) ..... 2007-317749

(51) Int. Cl.
*H01R 12/00* (2006.01)

(52) U.S. Cl. ..... 439/63; 439/74

(58) Field of Classification Search ..... 439/63, 439/581, 74; 361/790, 735, 742, 758, 770, 361/804

See application file for complete search history.

(56) References Cited

U.S. PATENT DOCUMENTS

| | | | | |
|---|---|---|---|---|
| 5,380,211 | A * | 1/1995 | Kawaguchi et al. | 439/74 |
| 5,411,409 | A * | 5/1995 | Gray et al. | 439/329 |
| 5,807,117 | A * | 9/1998 | Kempf et al. | 439/63 |
| 5,860,812 | A * | 1/1999 | Gugliotti | 439/63 |
| 6,079,986 | A * | 6/2000 | Beshears | 439/63 |
| 6,231,352 | B1 * | 5/2001 | Gonzales | 439/66 |

FOREIGN PATENT DOCUMENTS

| | | | |
|---|---|---|---|
| JP | 1993299141 | A | 11/1993 |
| JP | 2001160437 | A | 6/2001 |

* cited by examiner

*Primary Examiner*—Xuong M Chung-Trans

(57) ABSTRACT

A coaxially connected structure for opposed wiring substrates of the present invention includes a first substrate equipped with a tab type bracket and a second substrate equipped with a socket type bracket, and further includes first and second ground cases respectively mounted on the first and second substrates to cover them. The first and second ground cases are respectively provided with first and second penetration openings to pass the tab type bracket and the socket type bracket therethrough. Exposed parts of the tab type bracket and the socket type bracket from the openings are mutually engaged and being fully surrounded with at least one conductive tubular member which has a function to determine a distance between the first substrate and the second substrate.

11 Claims, 6 Drawing Sheets

COAXIALLY CONNECTED STRUCTURE FOR OPPOSED WIRING SUBSTANCES AND DEVICE HAVING THE SAME

INCORPORATION BY REFERENCE

This application is based upon and claims the benefit of priority from Japanese Patent Application No. 2007-317749, filed on Dec. 7, 2007, the disclosure of which is incorporated herein in its entirety by reference.

BACKGROUND OF THE INVENTION

1. Technical Field

The present invention relates to a connecting structure between circuit substrates each having a coaxial connector arranged face-to-face relationship, and a device equipped with the same. More specifically, the present invention relates to coaxially connected structure for opposed wiring substrates, and a device equipped with the same connected structure.

2. Background Art

In recent years, a printed wiring substrate mounted on an electronic apparatus such as wireless transmitter and receiver is fabricated by laminating a needed number of circuit substrates depending on required amount of signal processing. In this case, a coaxial signal connection between laminated printed wiring substrates is performed by using either a stacking connection or cable connection by providing an axial connector on both substrates. The stacking connection is achieved by using two coaxial connectors each of which is provided on the printed wiring substrates, respectively.

However, in case of using the stacking connection, when pluralities of coaxial connectors are provided on both wiring substrates, poor connection tends to be caused due to occurrence of positional displacement between two substrates arranged to be opposed each other in a face-to-face manner. In order to avoid such poor connection, it is necessary to use an expensive connector equipped with a floating function, otherwise, just stop using the pluralities of coaxial connectors.

In contrast, in case of such connection using a connecting cable, an expensive noise filtering member with the good noise shielding performance has to be used. This is because a signal component tends to leak from a coating layer of a cable body to cause noises, and also a signal tends to leak from a connector joint part and an opening for passing the cable therethrough, and thereby causing interference between adjacent signals.

As examples of related technology of the connecting structure for such coaxial connection between two printed wiring substrates via connector joint part, a patent document 1 (Japanese Patent Application Laid-Open No. 2001-160437) and a patent document 2 (Japanese Patent Application Laid-Open No. HEI-5(1993)-299141) are known.

These documents disclose the connection structure for smoothly and effectively connecting high-frequency signal lines and ground lines of two printed wiring substrates, respectively, intended to fabricate a compact size for a connecting structure of the coaxial connector.

SUMMARY

An exemplary object of the invention is to provide a coaxially connected structure for opposed wiring substrates, and a device equipped with the same connected structure to improve inconveniences which is tended to occur in the above-mentioned related technology by achieving effective coupling between the two opposing printed wiring substrates while maintaining a high electromagnetic shielding function.

According to an exemplary aspect of the invention of the present invention, a coaxially connected structure for opposed wiring substrates includes a first substrate equipped with a tab type bracket and a second substrate equipped with a socket type bracket, and further includes first and second ground cases respectively mounted on the first and second substrates to cover them. The first and second ground cases are respectively provided with first and second penetration openings to pass the tab type bracket and the socket type bracket therethrough. Moreover, exposed parts of the tab type bracket and the socket type bracket from the openings are mutually engaged and being fully surrounded with at least one conductive tubular member which has a function to determine a distance between the first substrate and the second substrate.

BRIEF DESCRIPTION OF THE DRAWINGS

Exemplary features and advantages of the present invention will become apparent from the following detailed description when taken with the accompanying drawings in which.

EXEMPLARY EMBODIMENT

Exemplary embodiments of the present invention will now be described in detail in accordance with the accompanying drawings.

In the first exemplary embodiment, a connector structure for a coaxial connection between two opposing printed wiring substrates using single combination of the tab type bracket and the socket type bracket is described. In the second exemplary embodiment, a connector structure for coaxial connection between two face-to-face substrates using plural combinations of the tab type brackets and the socket type brackets is described. In the third exemplary embodiment, other example of a connecting structure between the circuit substrates using the same connecting structure is described.

The First Exemplary Embodiment

Hereinafter, the first exemplary embodiment of the present invention will be described in accordance with accompanying drawings.

Figure 1:
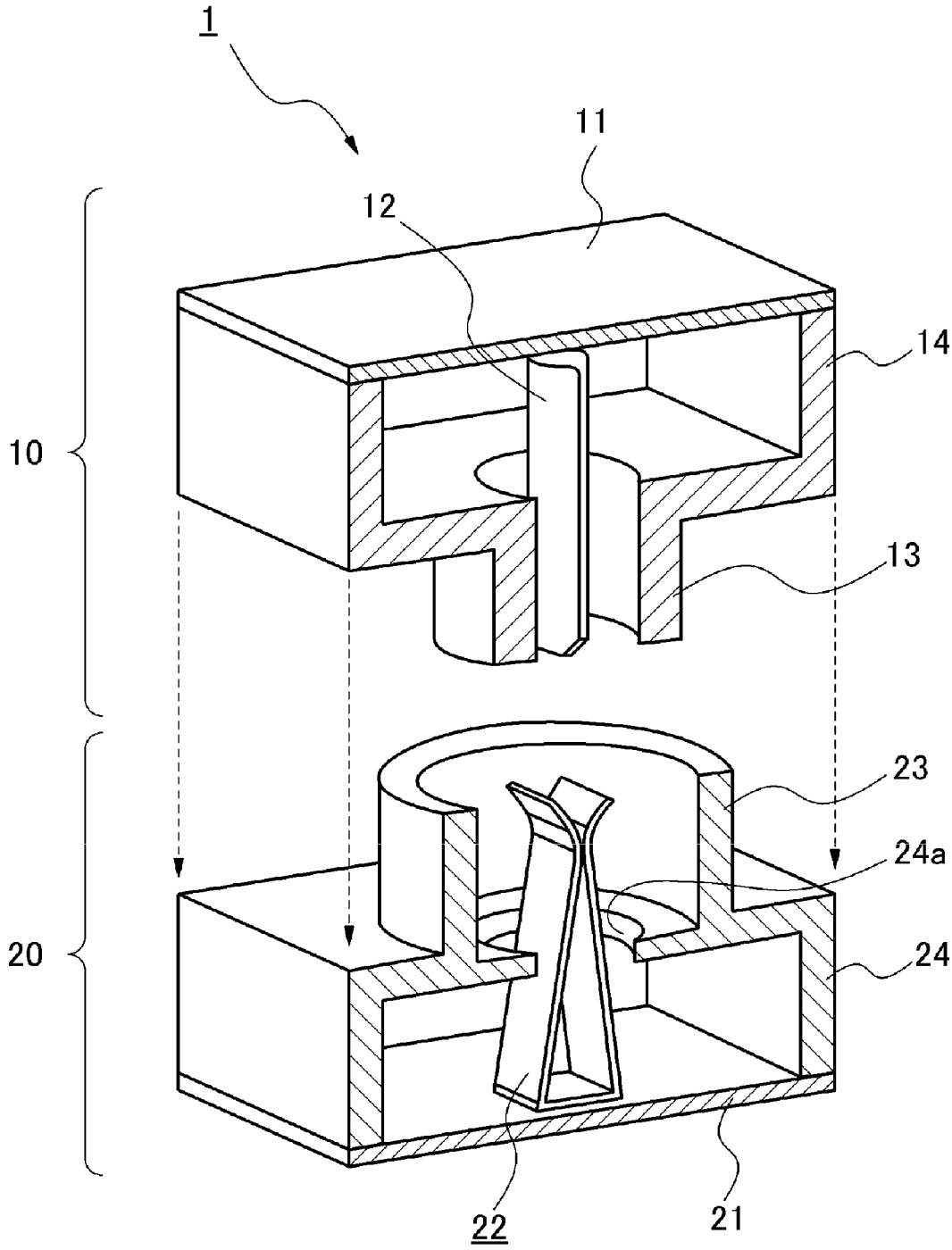
FIG. 1 is a partially sectioned perspective view showing an assembling stage for a first exemplary embodiment of the present invention.
Figure 2:
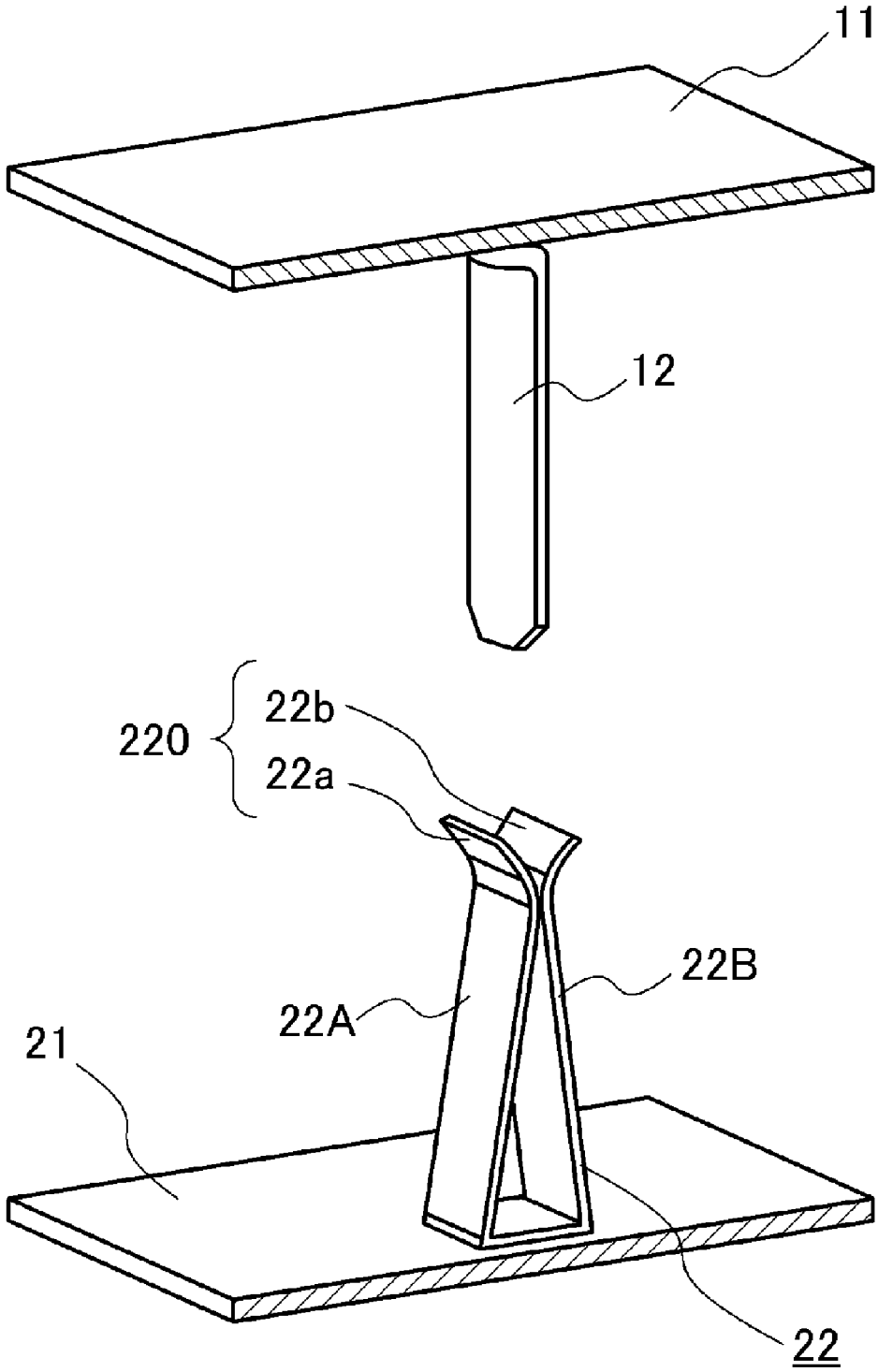
FIG. 2 is a perspective view showing a corresponding relationship between a tab type bracket (a male side) and a socket type bracket (a female side) in the first exemplary embodiment shown in FIG. 1.
Figure 3:
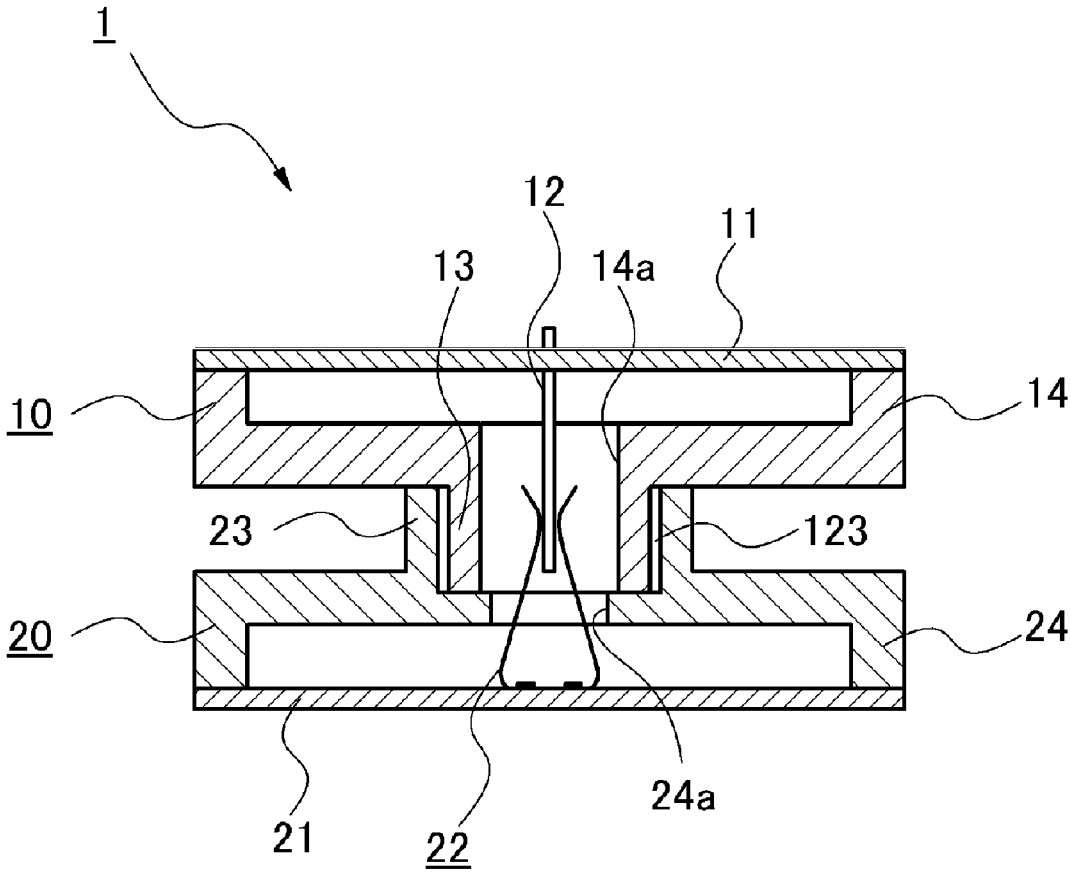
FIG. 3 is a cross sectional view showing a structure after assembly process of the first exemplary embodiment shown in FIG. 1.

First of all, referring to FIG. 1 to FIG. 3, a single coaxial connecting structure is described. A combination of a single tab type bracket and a single socket type bracket is placed within two conductive tubular members supported by grounded cases respectively mounted on opposing two printed wiring substrates for providing a double shielding structure.

First, a basic structure will be described.

The tab type bracket (the male side) 12 mounted on one printed wiring substrate 11 or a first substrate 11 and the socket type bracket (female) 22 mounted on the other printed wiring substrate 21 or a second substrate 21 are coupled to each other to electrically connect the first substrate 11 and the second substrate 21 which would be mounted within a wireless transmitter and receiver. A coaxial signal connection section is fabricated by surrounding a connection part of the tab type bracket 12 and the socket type bracket 22 with metal such as a first metal tube 13 and a second metal tube 23 so as to secure coaxial signal characteristic. The socket type bracket 22 is provided with a guidance function to receive the tab type bracket 12.

In the structure shown in FIG. 1 to FIG. 3, the tab type bracket 12 and the socket type bracket 22 installed on the printed wiring substrates 11 and 21 enable an electrical connection between the first substrate 11 and the second substrate 21 by coupling them each other. Coaxial signal characteristic with noise shielding function is secured by covering each coaxial signal connection section of the two brackets 12 and 22 with the metal tubes 13 and 23, respectively. Guiding function is provided not only to the socket type bracket 22, but also to the metal tubes 13 and 23 in order to prevent a positional displacement at the time of coupling process.

Hereinafter, the above mentioned structure is explained more in detail.

First, in FIG. 1, a reference numeral 1 indicates a connection structure between a first connector module 10 and a second connector module 20 for coupling two wiring substrates and a coaxial connector. As shown in FIG. 1 and FIG. 2, this substrate connecting structure 1 with a coaxial connector includes the tab type bracket 12 which is a connecting pin protruded from first substrate 11 and the socket type bracket 22 equipped with a spring which corresponds to this tab type bracket 12 and being protruded from the second substrate 21 so as to pinch the tab type bracket 12. The tab type bracket 12 is protruded downward in FIG. 1 from a central part of a lower surface of the first substrate 11.

The socket type bracket 22 is protruded toward the tab type bracket 12 from a central part of the second substrate 21 such that it is arranged on a coaxial line of the tab type bracket 12.

The tab type bracket 12 and the socket type bracket 22 are surrounded by the first tube 13 and the second tube 23, respectively. The first tube 13 and the second tube 23 are made of metal member so as to have a shield function for arrival electro-magnetic waves.

The first substrate 11 is covered with a box-shaped first ground case 14 having a cross section of U-shape such that the entire surface facing the second substrate 21 is covered and shielded. The second substrate 21 is also covered with a box-shaped second ground case 24 having a cross section of U-shape such that the entire surface facing the first substrate 11 is covered and shielded.

These cases 14 and 24 for groundings are formed to be resembled each other for their shape and size, but not exactly the same as shown in FIG. 1. Each of the first case 14 and the second case 24 is provided with a relatively large opening 14*a* and 24*a* to pass through the brackets 12 and 22 in a midsection on the side opposing to the first substrate 11 and the second substrate 12, respectively.

The first case 14 and the second case 24 are further provided with the first tube 13 and the second tube 23, respectively, around the penetration openings 14*a* and 24*a* in an integrated manner. In this case, it is preferable to form the first tube 13 and the second tube 23 with a metal member identical to the material of the first case 14 and the second case 24 for groundings.

As a result, the tab type bracket 12 is effectively shielded from an external high frequency noise or the like come from outside including the substrate 21.

Similarly, the socket type bracket 22 is effectively shielded from the external high frequency noise or the like come from outside including the substrate 11.

The first connector module 10 for the tab type bracket 12 and the second connector module 20 for the socket type bracket 22 are coupled each other along a dotted line arrow as shown in FIG. 1 and results in the state shown in FIG. 3. The tube 13 has an external diameter smaller than an internal diameter of the other tube 23 in this exemplary embodiment.

As shown in FIG. 3, since the tab type bracket 12 is engaged with the socket type bracket 22 so as to be an interlocking state, both brackets 12 and 22 are surrounded with a double shielded structure, and thereby a high frequency wave shielding and the electromagnetic shielding are performed effectively and certainly. Needless to say, the first tube 13 and the second tube 23 are freely inserted and detached each other.

In this exemplary embodiment shown in FIG. 3, the size of the first tube 13 and the second tube 23 for the double shielding structure are designed so as to produce a space gap 123 between the outer wall of the tube 13 and the inner wall of the tube 23 for adjusting a positional displacement of the opposing connector modules 10 and 20. This space gap 123 forms a cylindrical space gap as a whole to produce an effective function during an adjustment when engaging the first connector module 10 of the tab type bracket 12 with the second connector module 20 of the socket type bracket 22.

That is, during engagement of the brackets 12 and 22, even if there is a little difference in center axes or inclination or the like in any one of the brackets 12 and 22, the center position can be put together by shifting either one of the connector modules 10 and 20, and thereby enabling smooth and quick adjustment between the tab type bracket 12 and the socket type brackets 22.

In this first exemplary embodiment, the socket type bracket 22 is composed of two strips of conductive spring members 22A and 22B to pinch the tab type bracket 13. These spring members 22A and 22B are formed by bending a strip of conductive spring member as shown in FIG. 2 to provide a guide unit 220 with tip parts 22*a* and 22*b* which are opened toward the tab type bracket 12 like a wide angle mouth.

By using such structure, it makes easy for adjustment of engaging the first connector module 10 with the tab type bracket 12 and the second connector module 20 with the socket type bracket 22. That is, even if any one of each brackets 12 and 22 tilts to an expanding direction (the horizontal direction in FIG. 2) of the guide unit 220 greatly, the guide unit 220 becomes possible to receive and guide the tab type bracket 12 into the socket type bracket 22 effectively.

When one of tip ends of either the bracket 12 or the bracket 22 tilts toward the width direction of the guide unit 220, the tab type bracket 12 is effectively received owing to the width dimensions of the guide unit 220 and two strips of the conductive spring members 22A and 22B under relationship of cooperation among them.

Since the tab type bracket 12 as the connecting pin mentioned above is formed out of a strip of plate member in this first exemplary embodiment, its mechanical strength is increased compared with a conventional needle like connecting pin. Thus the durability of the whole system is substantially increased by avoiding occurrence of many bended connecting pins. Moreover, even if substantial positional displacement occurs in the direction parallel to the plate face of the tab type bracket 12 during the engagement of both brackets 12 and 22, its contact areas are large enough to avoid a poor electrical contact between the tab type bracket 12 and the socket type brackets 22.

The two conductivity spring members 22A and 22B of the socket type bracket 22 is designed to be formed like an isosceles triangle standing on the other substrate 21 such that the spring members 22A and 22B are faced each other. According to such shape and structure, the socket type bracket 22 can be fixed on the other substrate 21 in the stable state, this is because the contact area between the socket type bracket 22 and the second substrate 21 can be enlarged. For this reason, stable operation for insertion and detachment of the tab type bracket 12 is achieved and thereby producing such advantage as increased durability.

As mentioned above, FIG. 1 and FIG. 2 indicate the state before coupling the coaxial signal connection section constructed with the tab type bracket 12 and the socket type bracket 22, and FIG. 3 indicates the state after the coupling them.

When engaging the first substrate 11 with the second substrate 21 in FIG. 1, the first ground case 14 and the second ground case 24 are aligned so as to be overlapped each other in a separated condition at first. Then the first connector module 10 is moved toward the second connector module 20 along a dotted line arrow. Usually, both axes of the tab type bracket 12 and the socket type bracket 22 are set on the same straight line. Therefore, the first metal tube 13 and the second metal tube 23 are smoothly engaged with each other along with the movement while keeping both axes of the tab type bracket 12 and the socket type bracket 22 so as to be mutually guided each other. Accordingly, the tab type bracket 12 is pinched by the socket type bracket 22, and connection assembly operation with the modules 10 and 20 is completed.

According to this first exemplary embodiment, since the tab type bracket 12 moves along the same axis of the socket type bracket 22 and is engaged smoothly by overlapping the first substrate 11 and the second substrate 21 by coupling the first case 14 and the second case 24, round trip electrical transmission of a high-frequency signal can be performed mutually. In such condition, since the first tube 13 is engaged with the second tube 23 and the engaged brackets 12 and 22 are surrounded with the double shielding structure by the first tube 13 and the second tube 23, the high shielded state is maintained against arriving high frequency waves and electromagnetic waves.

Moreover, since the first case 14 and the second case 24 for groundings are always interposed between the overlapped two substrates 11 and 21, its shielding effect is efficiently achieved. Therefore, mutual interference of a high-frequency signal can be excluded effectively, and the first tube 13 is engaged with the second tube 23 so that freely inserted and detached. Accordingly, it is possible to carry out connection work between the first substrate 11 and the second substrate 21 efficiently, and achieve an excellent connecting structure between two substrates by using coaxial connectors with improvement of the productivity and the maintainability which are not attained by the related technology.

The Second Exemplary Embodiment

Next, the second exemplary embodiment of the present invention will be described based on FIG. 4 and FIG. 5. An identical reference numeral will be used about constructional element identical with each constructional element in the first exemplary embodiment mentioned above.

Although the first exemplary embodiment shows the case equipped with only one coupling set of the tab type bracket 12 and the socket type bracket 22, this second exemplary embodiment has a feature that a plurality of coupling sets of the similar tab type brackets 12 and socket type brackets 22 are used for a coaxially connected device 2 of the opposed first substrate 51 and the second substrate 61.

Figure 4:
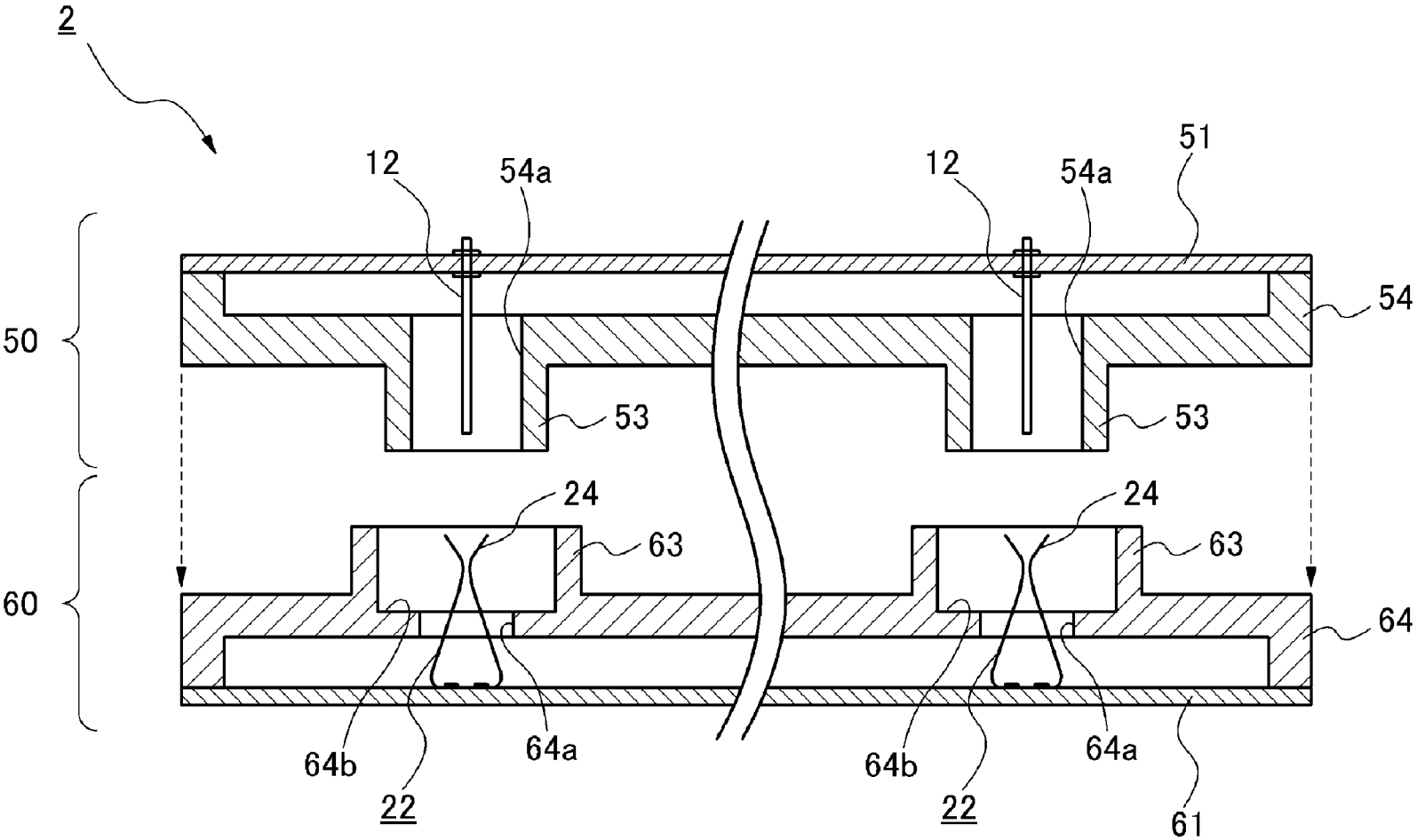
FIG. 4 is a cross sectional view showing an assembling stage for a second exemplary embodiment of the present invention.
Figure 5:
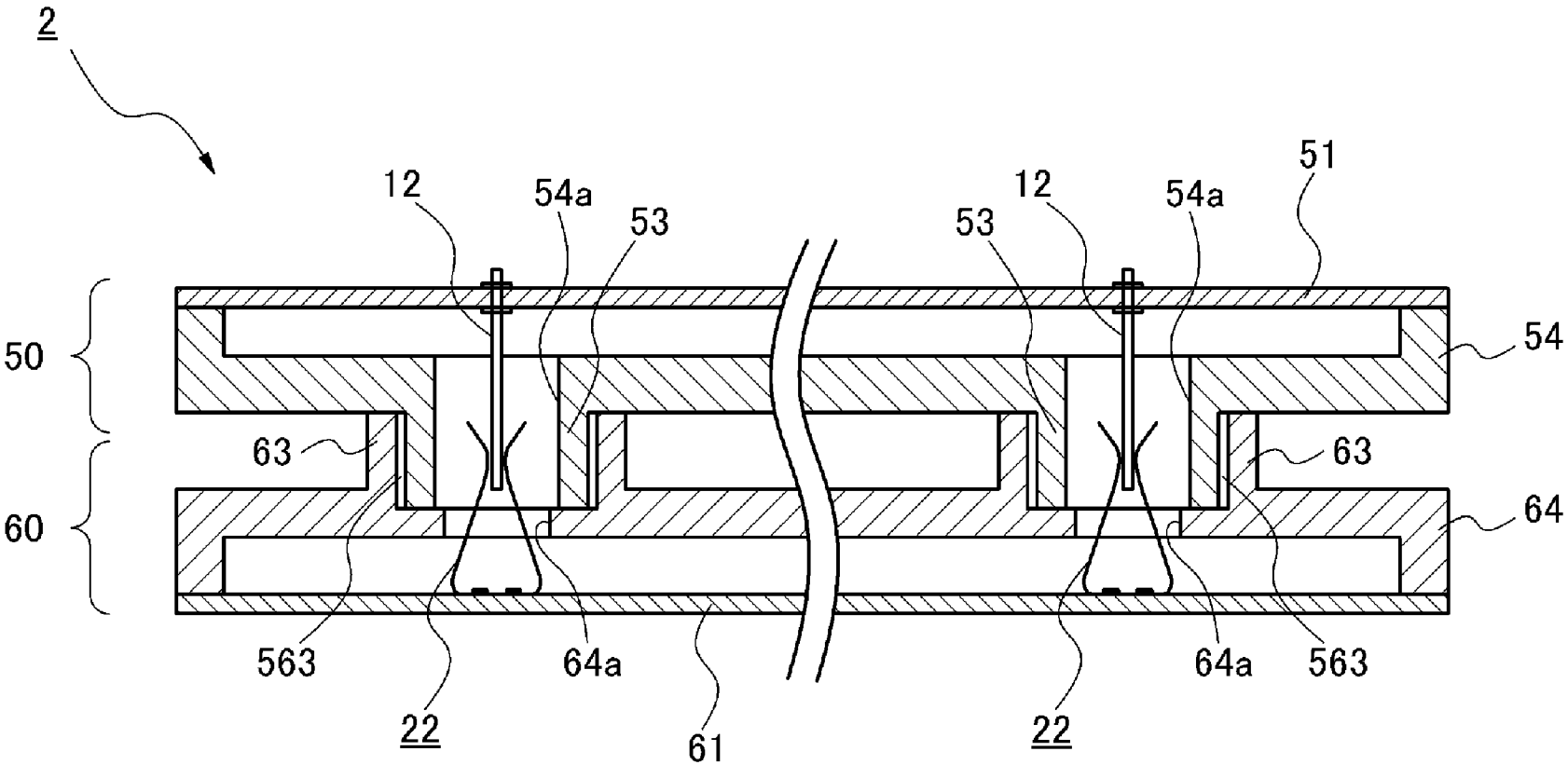
FIG. 5 is a cross sectional view showing a structure after assembly process of the second exemplary embodiment shown in FIG. 4.

First, the structure of the coaxial signal connection section in a wireless transmitter and receiver in this second exemplary embodiment is shown in FIG. 4 and FIG. 5. In this case, this exemplary embodiment includes a first connector module 50 of a first substrate 51 (printed wiring substrate) and a second connector module 60 of a second substrate 61 (printed wiring substrate).

The first connector module 50 is provided with a plurality of tab type brackets 12, and it is also equipped with a first case 54 for groundings so as to cover the surface of the first substrate 51 which is facing the other substrate 61. The first case 54 is provided with a plurality of cylinder shaped metal tubes 53 each having a male-type circular shape so as to surround the tab type brackets 12, respectively.

The second connector module 60 is provided with a plurality of socket type brackets 22, and it is also equipped with a second case 64 for groundings so as to cover the surface of the second substrate 61 which is facing the first substrate 51. The second case 64 is provided with a plurality of cylinder shaped metal tubes 63 each having a female-type circular shape so as to surround the socket type brackets 22, respectively.

The state of prior to coupling of the coaxial signal connection section is shown in FIG. 4, and coupled state is shown in FIG. 5.

The first case 54 and the second case 64 for groundings in the first connector module 50 and the second connector module 60 become a standard guide respectively, and all each joints where a plurality of positions are properly placed at right positions.

When the first tubes (male mold) 53 of the first connector module 50 is inserted into the second tubes (circle shape female) 63 with the concave shape protruded from the ground case 64 of the second connector module 60, the tab type brackets 12 installed in the printed wiring substrate 51 is guided into the socket type brackets 22 installed in the printed wiring substrate 61, and a plurality of positions are engaged at the same time and smoothly as shown in FIG. 5. Since a cylinder-like space gap 563 is provided between the first tubes 53 and the second tubes 63 to provide a gentle mutual coupling condition therebetween like in the case shown in FIG. 3, its engaged operation is carried out smoothly.

More specific structure will be explained in detail hereinafter.

First, in FIG. 4 and FIG. 5, a coaxially coupled device 2 for the first substrate 51 and the second substrate 61 includes a plurality of tab type brackets 12 and a plurality of socket type brackets 22. The tab type brackets 12 as connecting pins are protruded from the first substrate 51 with a predetermined interval. The socket type brackets 22 are protruded from the second substrate 61 at positions corresponding to the tab type brackets 12 so as to pinch the tab type brackets 12 respectively using its spring function.

Each of the tab type brackets 12 is surrounded by each of first tubes 53 having electromagnetic shielding function to shelter an arrival radio wave like in the first case of FIG. 1. The tubes 53 are commonly supported by the case 54 for groundings which is mounted on the first substrate 51.

The first connector module 50 includes the above-mentioned first case 54 mounted on the first substrate 51, the first tubes 53 supported by the first case 54, and the tab type brackets 12 as connecting pins arranged in the first tubes 53, respectively.

Each of the socket type brackets 22 to be engaged with each of the tab type brackets 12 is surrounded by each of second tubes 63 having electromagnetic shielding function to shelter an arrival radio wave like in the case of FIG. 1. The second tubes 63 are commonly supported by the second case 64 for groundings which is mounted on the second substrate 61.

The second connector module 60 includes the above-mentioned second case 64 mounted on the second substrate 61, the second tubes 63 supported by the second case 64, and the socket type brackets 22 as pinching spring members arranged in the second tubes 63 to receive the connecting pins, respectively.

The external diameter of each of the first tubes 53 is designed to be smaller than the inner diameter of each of the second tubes 63 such that each of the first tubes 53 is engaged into the second tubes 63 so as to be freely inserted and detached on the identical axis line.

Since each of the tab type brackets 12 is engaged with each of the socket type bracket 22 so as to be an interlocking state, both brackets 12 and 22 are respectively surrounded with a double shielded structure like in the case of the first exemplary embodiment mentioned above, and thereby the electromagnetic shielding are performed effectively and certainly. Needless to say, the first tube 63 and the second tube 63 are freely inserted and detached each other.

In FIG. 4 and FIG. 5, reference numerals 54*a* indicate first penetration openings for the tab type brackets 12 which are provided in the first ground cases 54. Reference numerals 64*a* indicate penetration openings for the socket type brackets 22 which are provided in the second ground cases 64. Each of the second penetration openings 64*a* for socket type brackets 22 is formed smaller than each of the second penetration opening 54*a* for the tab type brackets 12 such that a tip end of the first tube 53 is stopped at a tube contact unit 64*b* formed around the second penetration openings 64*a* as shown in FIG. 4.

Both of the first case 54 and the second case 64 are resemble each other in its shape and size but not identical to enable easy coupling structure such that when the first case 54 and the second case 64 are overlapped to electrically connecting the first substrate 51 and the second substrate 61, each of the tab type brackets 12 is arranged on the identical axis corresponding to each of the socket type bracket 22. For this reason, coupling process between the first substrate 51 and the second substrate 61 can be carried out smoothly and quickly.

Moreover, in the double shielding structure including the first tubes 53 and the second tubes 63, a space gap 563 is provided between the outer surface of the first tube 53 and the inner surface of the second tube 63 like the ground case shown in FIG. 3 mentioned above. This space gap 563 forms a cylindrical space overall and functions effectively during an adjustment when engaging the first connector module 10 of the tab type brackets 12 with the second connector module 20 of the socket type brackets 22.

The shape and its structure of each of the brackets 12 and 22, and the shape and its engaging structure of the first tubes 53 and the second tubes 63, and its advantages are the same as the case of the first exemplary embodiment disclosed in FIG. 1 to FIG. 3 mentioned above.

The second exemplary embodiment has the same advantage of the first exemplary embodiment mentioned above. Moreover, at the time of connecting circuit side faces of the first substrate 51 and the second substrate 61, even if the number of the coaxial coupling points is more than one, it is possible to carry out the coupling process quickly and efficiently while maintaining the high shielded state in the same manner in the case of using a single combination of brackets 12 and 22 mentioned above, and provide an excellent coaxially connected device 2 for substrates with improvement of the productivity and the maintainability which are not achieved by the related technology.

The Third Exemplary Embodiment

Next, the third exemplary embodiment of the present invention will be described based on FIG. 6.

Here, an identical reference numeral will be used about constructional element identical with each constructional element in the second exemplary embodiment.

Figure 6:
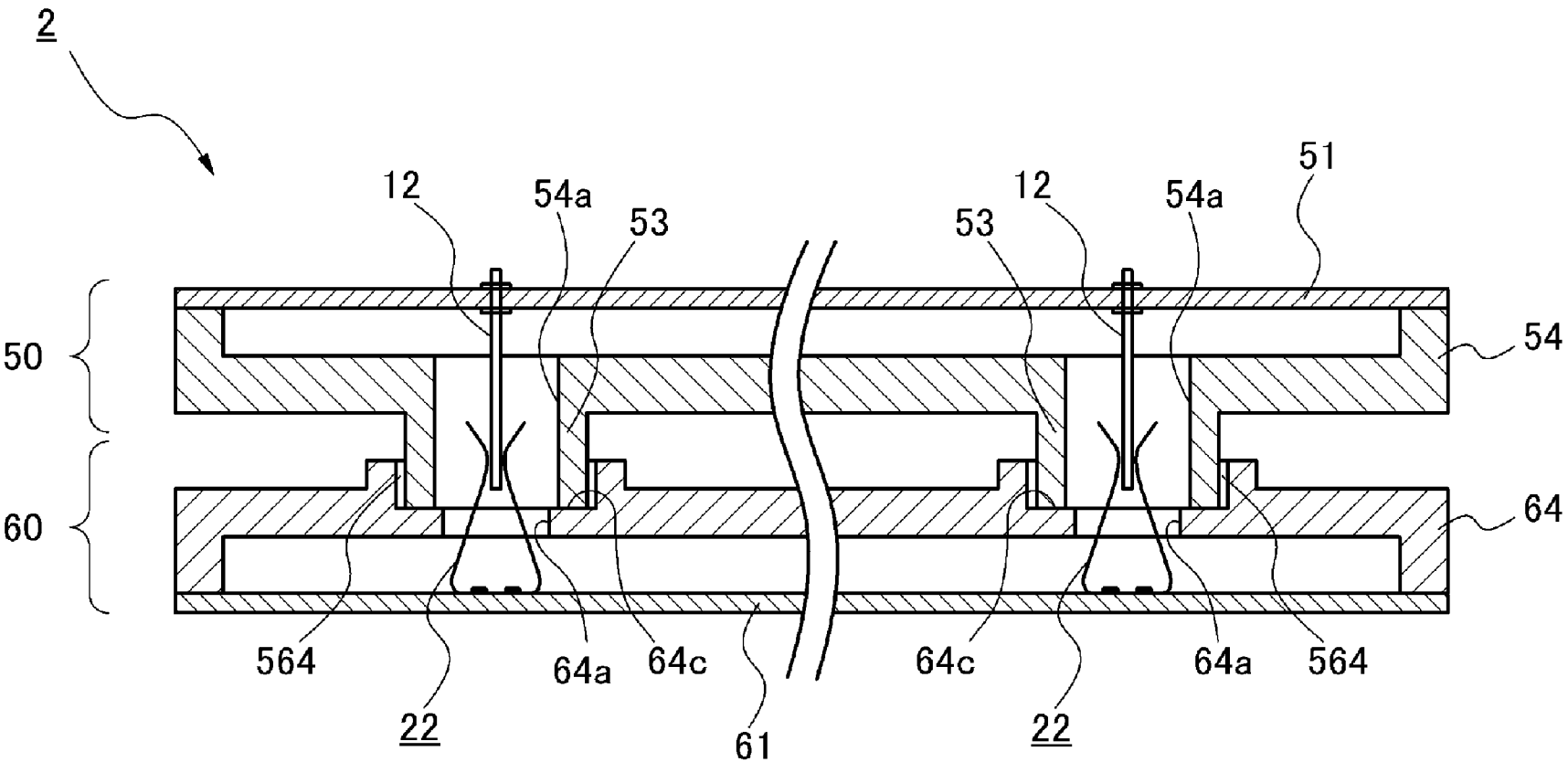
FIG. 6 is a cross sectional view showing a structure after assembly process of a third exemplary embodiment of the present invention.

The third exemplary embodiment shown in FIG. 6 has a feature that a shielding structure around each of the brackets 12 and 22 is formed only by one tube 53. This is in contrast to the second exemplary embodiment where each of the brackets 12 and 22 has a double shielding structure made of the first tubes 53 and the second tubes 63 (refer to FIG. 5).

Hereinafter, this will be described.

In FIG. 6, a coaxially coupled substrate device 3 includes a plurality of the tab type brackets 12 as connecting pins protruded from a plurality of positions of the first substrate 51, and a plurality of socket type brackets 22 having spring members protruded from a plurality of positions of the second substrate 61 to be engaged with the corresponding tab type brackets 12.

A first case 54 for the groundings is provided with a plurality of first penetration openings 54*a* for the tab type brackets 12 protruded from the first substrate 51 and being designed to cover the entire one surface thereof. A second case 64 for the groundings is provided with a plurality of second penetration openings 64*a* for the socket type brackets 22 protruded from the second substrate 61 and being designed to cover the entire one surface thereof.

Each of a plurality of the first tubes 53 is made of conductive member and which is designed to have a function to determine the distance between the opposed substrates 51 and 61. Each of the first tube 53 further has a function to entirely cover around both the brackets 12 and 22 which are engaged with each other when the two substrates 51 and 61 are overlapped each other. In FIG. 6, although the first tubes 53 are provided at the first openings 54*a* of the first case 54 to determine the distance between the first substrate 51 and the second substrate 61, the same function can be obtained by providing such tubes on either one of the penetration openings 54*a* and 64*a* for the brackets 12 and 22.

When the first substrate 51 and the second substrate 61 are arranged with face-to-face condition by coupling both first case 54 and the second case 64 for groundings, corresponding each tab type bracket 12 and socket type bracket 22 will be engaged smoothly like the case of the second exemplary embodiment mentioned above, both of the first substrate 51 and the second substrate 61 are mutually united smoothly. That is, even in this third exemplary embodiment, substantially the same advantages of the second exemplary embodiment can be obtained to achieve the above-mentioned objective.

The second case 64 for the groundings is provided with a plurality of concave receiving parts 64C at a plurality of second penetration openings 64*a*, respectively, for receiving the first tubes 53 as shown in FIG. 6. Moreover, a space gap 564 is provided between inside walls of the concave receiving parts 64C and outside wall of the first tubes 53.

A plurality of second penetration openings 64*a* for socket type brackets mentioned above are placed in the central part of the concave receiving part 64C, and they are arranged on each axis line identical with each of the brackets 12 and 22.

For this reason, even if a positional displacement between tab type brackets 12 and the socket type brackets 22 occurs during the overlapping process of the first substrate 51 and the second substrate 61, an adjustment for shifting either the first case 54 or the second case 64 somewhat in left and right can be performed during the overlapping process. Thus the mutual laminated operation for the first substrate 51 and the second substrate 61 can be carried out smoothly and quickly.

Other structures and its operational advantages are the same as the second exemplary embodiment mentioned above.

In the third exemplary embodiment, although the tab type brackets 12 are provided on the first substrate 51 while the socket type brackets 22 are provided on the second substrate 61, the tab type brackets 12 may be provided on the second substrate 61 while the socket type brackets 22 may be provided on the first substrate 51. Such interchangeable manner can be also applied to the first exemplary embodiment and the second exemplary embodiment mentioned above.

Although the third exemplary embodiment is based on the second exemplary embodiment by using the shielding structure around each above-mentioned plurality of brackets 12 and 22, each of the brackets shown in FIG. 6 may be applied to a single bracket engagement part in the first exemplary embodiment mentioned above including each single brackets 12 and 22 just as it is.

Moreover, in the foregoing exemplary embodiments, the first tube 13 (or 53) and the first ground case 14 (or 54) can be fabricated either by in an integrated manner from the beginning or by combining separated components for the first tube and the first case. The second tube 23 (or 63) and the second case 24 (or 64) are also fabricated in either way, i.e., they are integrated from the beginning or combined after processing separated components.

According to the exemplary embodiments mentioned above, inexpensive connecting structure can be realized by using surrounding metal members (the metal tubes 53 and 63) and connection members (combination of the tab type bracket 12 and the socket type bracket 22) fabricated by a sheet metal forming method. Such connecting structure acts as a coaxial connector having coaxial signal characteristic and signal shielding function. Furthermore, positional displacement at a joint portion (the connected part of the tab type bracket 12 and the socket type bracket 22) can be prevented and enabling concurrent connections at a plurality of connecting positions by giving the role of guiding function to the metallic members (the socket type bracket 22 and the metal tubes 53 and 63).

Although the tab type bracket (the male side) 12 is made to have a shape like a plate in each exemplary embodiment mentioned above, that shape may be a circle stick or a square bar shape. Although each shape of the metal tubes 13, 23, 53 and 63 is a circle shape for either function types of male or female, it may be a square shape. Moreover, number of concurrent connecting positions may be three or more.

In these exemplary embodiments, although the tubes 13, 23, 53 and 63 and ground cases 14, 24, 54 and 64 are made of metal member, those may be made of other material having the same function of metal, such as conductive plastic and a plastic tube having metalized inner wall. Moreover, although the socket type bracket (female) is made to have a shape of a triangle, it may be the other socket shapes.

And in these exemplary embodiments, although the guiding function is obtained by the combinational structure of the metal tubes 13, 23, 53 and 63 (by inserting a cylinder-shaped member (male type) into a hole-shaped member (female type), such guiding function can be made by using other shapes or other members.

The present invention can be employed as mounted structural section of signal processing in all telecommunications sectors of manufacturing industry and its related fields.

In the related technology described in each patent document mentioned above, although the miniaturization is possible, space around the connector joint part is not enough, thus attachment and detachment operation is not smooth, and when the connecting pin has an inclination or the like at tip end, it has inconvenience such as it is damaged or broken quickly by pressing operation at the time of connection operation.

The structure for an adjustment become complicated in the mutual connection structure of the substrate equipped with a plurality of connection points, and there is a trouble such as poor productivity due to the complexity of the structure and it takes time and effort for the coupling operations.

In the present invention, a solution method mentioned above is provided in order to provide either a coaxially connected structure for opposed wiring substrates or a coaxially connected device for opposed wiring substrates, which connects two substrates efficiently while maintaining high shielded state, and aiming at improving productivity and maintainability.

That is, the present invention includes the tab type bracket 12 protruded from the first substrate 11 and the socket type bracket 22 protruded from the second substrate 21 so as to be engaged with the tab type bracket 12. Each of these brackets 12 and 22 is separately surrounded by the first and second metal tubes 13 and 23 to be shielded from arrival radio wave. These tubes 13 and 23 are separately supported by the ground cases 14 and 24 mounted on the first substrate 11 and the second substrate 21, respectively. When the tab type bracket 12 is engaged with the socket type bracket 22, the first tube 14 is coupled to the second tube 24 so as to be freely inserted and detached in the second tube 24, and thereby providing the double shielding structure around the brackets.

The ground case 24 has a penetration opening for the socket type brackets protruded from the second substrate and being mounted on the second substrate so as to cover the entire one principal surface thereof.

And it is characterized in that the first tubular member is connected to at least one of the first opening formed on the first substrate and the second opening formed on the second substrate so as to surround a joint portion of the tab type bracket and the socket type bracket. The first tubular member has a function to determine a distance between the first substrate and the second substrate and being made of an electrically conductive material so as to electromagnetically shielding entire of the tab type bracket and the socket type bracket by electrically coupling the first tubular member with both of the first and second ground cases.

Moreover, in order to achieve the above-mentioned objective, a coaxially connected device of opposed wiring substrates according to the present invention includes that a plurality of the tab type brackets which are connecting pins protruded from the first substrate and the socket type brackets which correspond to those tab type brackets with spring function which are protruded from a plurality of positions of the second substrate and being engaged with the tab type brackets, respectively. It is also equipped with the first ground case mounted on the first substrate so as to cover entire one principal surface of the first substrate and being provided with a plurality of penetration openings for the tab type brackets protruded from the first substrate.

The second ground case is further included in the present invention such that the second ground case is provided with a plurality of penetration openings for socket type brackets protruded from the second substrate and being mounted on the second substrate so as to cover the entire one principal surface thereof.

And it is characterized in that a group of the first tubular members are connected to at least one group of the first openings formed on the first substrate and the second openings formed on the second substrate so as to surround joint portions of the tab type brackets and the socket type brackets. Each of the first tubular members has a function to determine a distance between the first substrate and the second substrate and being made of an electrically conductive material so as to electromagnetically shielding entire of the tab type brackets and the socket type brackets by electrically coupling the first tubular members with both of the first and second ground cases.

One of advantages of the present invention is that, since the tab type bracket of the first substrate moves along the same axis of the socket type bracket of the second substrate and they are engaged smoothly by overlapping the both substrates by coupling the ground cases, and the first tube is engaged with the second tube while the engaged brackets are surrounded with the double shielding structure by the first and second tubes, the high shielded state is maintained against arriving high frequency waves and electromagnetic waves. Moreover, since the ground cases are always interposed between the overlapped substrates, its shielding effect is efficiently achieved. Therefore, mutual interference of a high-frequency signal can be excluded effectively, and the first tube is engaged with the second tube so that freely inserted and detached. Accordingly, a coaxially connected structure for opposed wiring substrates or a coaxially connected device for opposed wiring substrates according to the present invention, it is possible to carry out connection work with each other of the two substrates efficiently, and achieve an excellent connecting structure between two substrates with coaxial connectors with improvement of the productivity and the maintainability which are not attained by the related technology.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

Further, it is the inventor's intention to retain all equivalents of the claimed invention even if the claims are amended during prosecution.

What is claimed is:

1. A coaxially connected structure for opposed wiring substrates comprising:

a tab type bracket as a connecting pin protruded from a first substrate;

a socket type bracket protruded from a second substrate for receiving said tab type bracket with spring member;

a first ground case mounted on said first substrate so as to cover an entire principal surface of said first substrate, said first ground case being provided with a first opening to pass said tab type bracket therethrough;

a second ground case mounted on said second substrate so as to cover an entire principal surface of said second substrate, said second ground case being provided with a second opening to pass said socket type bracket therethrough; and a first tubular member connected to at least one of said first opening and said second opening so as to surround a joint portion of said tab type bracket and said socket type bracket, said tubular member having a function to determine a distance between said first substrate and said second substrate and being made of an electrically conductive material so as to electromagnetically shielding entire of said tab type bracket and said socket type bracket by electrically coupling said tubular member with both of said first ground case and said second ground case.

2. The coaxially connected structure for opposed wiring substrates according to claim 1, wherein another one of said first opening and said second opening is provided with a concave portion to receive said tubular member so as to form a space gap between an inner wall of said concave portion and an outer wall of said tubular member.

3. The coaxially connected structure for opposed wiring substrates according to claim 1, further comprising a second tubular member connected to another one of said first opening and said second opening so as to be placed inside or outside of said first tubular member, wherein said second tubular member is made of an electrically conductive material so as to electromagnetically shielding entire of said tab type bracket and said socket type bracket by electrically coupling said second tubular member with both of said first ground case and said second ground case, and thereby providing a double-shielded structure.

4. The coaxially connected structure for opposed wiring substrates according to claim 3, wherein said first tubular member and said second tubular member are spaced apart from each other to provide a space gap between side walls thereof for positional displacement adjustments of said double-shielded structure.

5. The coaxially connected structure for opposed wiring substrates according to claim 1, wherein said tab type bracket has a strip-shaped tip end and said socket type bracket is formed out of two strips of conductivity spring members to provide a guide portion of widely opened toward an insertion direction of said tab type bracket for pinching said strip-shaped tip end such that said strip-shaped tip end is guided into said socket type bracket.

6. The coaxially connected structure for opposed wiring substrates according to claim 1, wherein said socket type bracket is formed out of two strips of conductivity spring members to provide a guide portion of widely opened toward an insertion direction of said tab type bracket for pinching said tab type bracket such that said tab type bracket is guided into said socket type bracket, and said spring members are formed like an isosceles triangle sanding on said second substrate.

7. A coaxially connected device of opposed wiring substrates comprising:

a plurality of tab type brackets as connecting pins protruded from a first substrate;

a plurality of socket type brackets protruded from a second substrate for receiving said tab type brackets with spring members;

a first ground case mounted on said first substrate so as to cover an entire principal surface of said first substrate, said first ground case being provided with a plurality of first openings to pass said tab type brackets therethrough;

a second ground case mounted on said second substrate so as to cover an entire principal surface of said second substrate, said second ground case being provided with a plurality of second openings to pass said socket type brackets therethrough; and a plurality of first tubular members connected to at least one of said first openings and said second openings so as to surround joint portions of said tab type brackets and said socket type brackets, said tubular members having a function to determine a distance between said first substrate and said second substrate and being made of an electrically conductive material so as to electromagnetically shielding entire of said tab type brackets and said socket type brackets by electrically coupling said tubular members with both of said first ground case and said second ground case.

8. The coaxially connected device for opposed wiring substrates according to claim 7, wherein another one group of said first openings and said second openings is provided with concave portions to receive said tubular members so as to form a space gap between each of an inner walls of said concave portions and each of an outer walls of said tubular members.

9. The coaxially connected device for opposed wiring substrates according to claim 7, further comprising a second group of tubular members connected to another group of said first openings and said second openings so as to be placed inside or outside of said first tubular members, wherein each of said second tubular members is made of an electrically conductive material so as to electromagnetically shielding entire of said tab type brackets and said socket type brackets by electrically coupling said second tubular members with both of said first ground case and said second ground case, and thereby providing double-shielded structures.

10. The coaxially connected device for opposed wiring substrates according to claim 9, wherein said first tubular members and said second tubular members are spaced apart from each other to provide a space gap between each of side walls thereof for positional displacement adjustments of said double-shielded structure.

11. The coaxially connected device for opposed wiring substrates according to claim 10, wherein each of said tab type brackets has a strip-shaped tip end and each of said socket type brackets is formed out of two strips of conductivity spring members to provide a guide portion of widely opened toward an insertion direction of said tab type brackets for pinching said strip-shaped tip ends such that said strip-shaped tip ends are guided into said socket type brackets.

* * * * *